US006002780A

United States Patent [19]

Espiritu

[11] Patent Number: 6,002,780

[45] Date of Patent: Dec. 14, 1999

[54] AUDIO SPEAKER HAVING ROTATABLE TWEETER

[75] Inventor: Ronnie S. Espiritu, Castaic, Calif.

[73] Assignee: Harman International Industries, Incorporated, Northridge, Calif.

[21] Appl. No.: 09/110,623

[22] Filed: Jul. 6, 1998

[51] Int. Cl.[6] ..... H04R 25/00

[52] U.S. Cl. ..... 381/182; 381/387; 181/144

[58] Field of Search ..... 381/89, 332, 182, 381/186, 387, 86; 181/144, 152, 155, 163, 164, 165

[56] References Cited

U.S. PATENT DOCUMENTS 3,796,839 3/1974 Torn ..... 381/182
4,727,586 2/1988 Johnson ..... 381/182
5,629,501 5/1997 Fenton ..... 381/186
5,739,480 4/1998 Lin ..... 381/186

*Primary Examiner*—Huyen Le
*Attorney, Agent, or Firm*—Jones, Day, Reavis & Pogue

[57] ABSTRACT

An audio speaker unit including a low-frequency range speaker providing a first sound output directivity along a center axis with a conical diaphragm extending outwardly from a neck to an outer edge and a high-frequency range speaker rotatably mounted to the unit along the center axis of the low-frequency range speaker and positioned within the conical diaphragm and below the outer edge and having a second sound output directivity fixed at an angle to the center axis of the low-frequency range speaker so that by rotating the high-frequency range speaker, the second sound directivity can be arcuately positioned in at least one plane perpendicular to the center axis.

8 Claims, 2 Drawing Sheets

AUDIO SPEAKER HAVING ROTATABLE TWEETER

BACKGROUND OF THE INVENTION

1. Field of the Invention

The present invention relates in general to audio speakers and in particular to an audio speaker having both a low-frequency conical speaker and a high-frequency conical tweeter mounted along the central axis of the low-frequency speaker but having an audio sound directivity at an angle to the center axis that is arcuately rotatable about the center axis. The high-frequency tweeter is within the conical diaphragm of the low-frequency speaker and forward of the neck of the conical diaphragm of the low-frequency speaker.

2. Description of Related Art Including Information Disclosed Under 37 CFR 1.97 and 1.98

Coaxial audio speakers are well known in the art. They typically have a low-frequency "woofer" and a high-frequency "tweeter" that is mounted along the center axis of the low-frequency woofer.

It is sometimes desirable to cause the directivity of the high-frequency tweeter to be at an angle with the center axis of the low-frequency speaker and having an angular direction that can vary. In U.S. Pat. No. 4,365,114, such speaker is disclosed in which a high-range speaker unit is pivotally mounted above the low-range speaker unit on a frame structure and is freely rotatable in a horizontal direction. This allows directivity of the high-frequency speaker to be changed not only in a vertical angle with respect to the center axis but also in a horizontal angle with respect to the vertical axis of the low-frequency speaker.

However, such arrangement requires a larger space for the speaker because the high-frequency speaker protrudes beyond the low-frequency speaker frame and requires an adjustment of the high-frequency speaker directivity in two planes.

It would be advantageous to have a coaxial speaker unit in which the directivity of the high-frequency speaker is at a fixed angle with respect to the center axis of the low-frequency speaker but which is adjustable in a horizontal plane about the center axis and in which the high-frequency speaker is located within the conical diaphragm of the low-frequency speaker and above the low-range speaker neck to which the conical diaphragm is attached so as to avoid the necessity of additional space in which to mount the speaker.

SUMMARY OF THE INVENTION

The present invention relates to an audio speaker unit having a low-range speaker with a conical diaphragm extending outwardly and forwardly from a neck about a center axis. The high-range conical speaker is mounted along the center axis of the low-range speaker. The high-range speaker element is rotatably mounted within the conical diaphragm of the low-frequency speaker and forward of the neck of the low-range speaker and at an angle to the center axis such that the directivity of the high-range speaker diaphragm is at a fixed angle with respect to the center axis and, because it is mounted within the conical diaphragm of the low-frequency speaker, it utilizes the same space as a normal coaxial speaker.

A base portion for the high-range speaker is attached to the low-range speaker along the center axis thereof. A spacer is rotatably mounted on and extends forwardly from the base portion and has a bottom portion and a top portion. The high-range speaker diaphragm is fixedly mounted on the top portion of the spacer but within the conical diaphragm of the low-frequency speaker and forwardly of the low-range speaker neck. It is mounted such that its directivity is at a fixed angle with respect to the center axis of the low-frequency speaker but is arcuately positionable about the center axis in a plane perpendicular thereto.

Thus, the audio speaker unit of the present invention is a unit that has both a low-frequency speaker and a high-frequency speaker mounted along the central axis of the low-frequency speaker but in which the high-frequency speaker is mounted wholly within the conical diaphragm, but above the neck, of the low-frequency speaker. The high-frequency speaker has a directivity that is at a fixed angle with respect to the center axis of the low-frequency speaker but is arcuately positionable about the center axis in a plane perpendicular to the central axis.

Thus it is an object of the present invention to provide an audio speaker unit that has a high-frequency speaker body mounted along central axis of the low-frequency speaker and that does not extend outwardly beyond the forward edge of the low-frequency speaker and thus requires no more space than a typical coaxial speaker.

It is still another object of the present invention to provide a low-frequency speaker having a high-frequency speaker body mounted along the central axis of the low-frequency speaker but whose acoustical directivity is fixed at an angle with respect to the central axis of the low-frequency speaker. It is also rotatable about the central axis of the low-frequency speaker in an arcuate manner.

Therefore the present invention relates to a speaker unit comprising a low-frequency range speaker having a conical diaphragm extending outwardly and forwardly and providing a first sound output directivity along a center axis, and a high-frequency range speaker rotatably mounted to said unit along the center axis of said low-frequency range speaker and positioned within the conical diaphragm and having a second sound output directivity that is fixed at an angle to the center axis of the low-frequency range speaker so that by rotating the high-frequency range speaker, the second sound output directivity can be arcuately positioned in a plane perpendicular to the center axis.

BRIEF DESCRIPTION OF THE DRAWINGS

These and other features of the present invention will be more fully disclosed when taken in conjunction with the following Detailed Description of the Invention in which like numerals represent like elements and in which.

DETAILED DESCRIPTION OF THE INVENTION

Figures 1, 2:
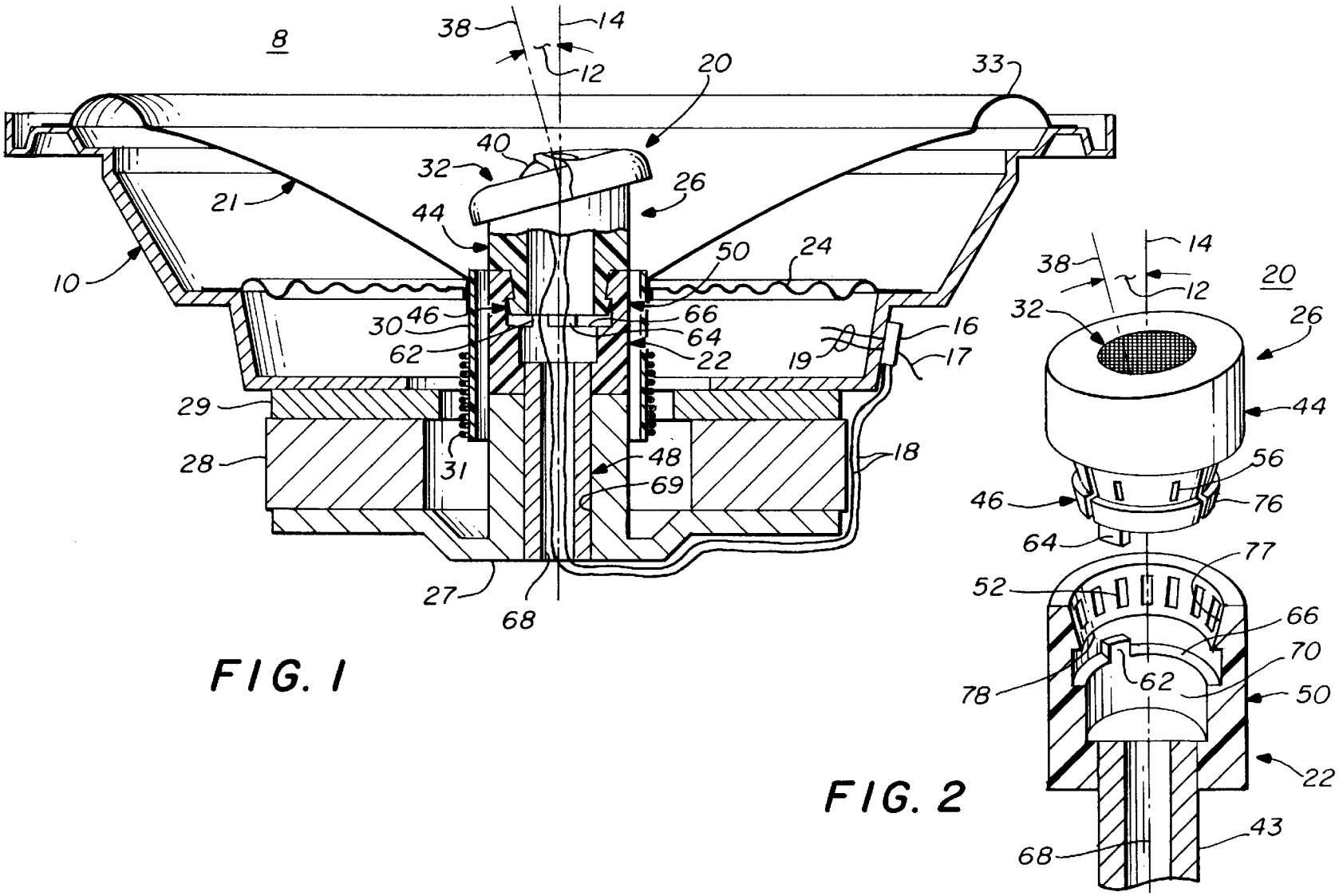
FIG. 1 is a cross-sectional view of the novel coaxial speaker of the present invention.
FIG. 2 is an exploded view of an embodiment of the high-frequency speaker that is mounted along the center axis of the low-frequency speaker as shown in FIG. 1 with its cap off to show the high-frequency speaker diaphragm.

The novel speaker unit 8 of the present invention is illustrated in FIG. 1 in cross-sectional form and includes a low-range speaker 10 and an angled and rotatable tweeter 20. The tweeter 20 may be for high-range frequencies or mid and high-range frequencies as desired. It may also be any type high-frequency speaker such as a conical speaker or a domed speaker. The tweeter 20 has a high-range speaker element 32 mounted at an angle 12 to the center line 14 of a hollow spacer unit 26 and has its own axis of sound directivity 38 at the fixed angle 12 with respect to the center line 14. The hollow spacer unit 26 is rotatably mounted to a hollow tweeter base portion 22. The base portion 22 is attached to the low-range speaker 10 along its center axis of sound directivity 14. A main terminal board 16 has input signals coupled thereto on terminals 17 and from there to the voice coil 31 of the low-frequency speaker 10 on voice coil bobbin 30 by conductors 19 in any well-known manner (not shown). However, the signals from the main terminal board 16 are also coupled on conductors 18 through the hollow base portion 22 and spacer 26 and are coupled to the high-frequency (or mid-range to high-frequency) speaker element 32. The voice coil 31 of the low-frequency speaker 10 is in a gap formed by pole pieces 27 and 29 that have a magnetic ring 28 between them. When the audio signal is received at the main terminal board 16 and passes through the voice coil 31, the voice coil bobbin 30 moves in a vertical plane in FIG. 1 and causes movement of the damper member 24 and the conical diaphragm 21 thus causing the low-frequency sounds. The audio signals coupled to the high-frequency speaker 32 are converted to audio sounds in the medium to high-range frequency that are projected in a line of directivity along line 38 which is, as stated earlier, at an angle 12 to the directivity axis 14 of the low-range speaker. The spacer 26 has a projection 64 thereon which rides on a shelf 66 of the base portion 22 as shown in FIG. 2. There is also a projection 62 on the shelf 66 of the base portion 22 and it prevents the spacer 26 from being rotated more than approximately 360°. This prevents the tweeter wires 18 from becoming twisted and eventually severed from their connectors to the high-frequency speaker diaphragm. It will be noted from FIG. 1 that the tweeter speaker 32 is positioned within the conical diaphragm 21 of the low-frequency speaker 10 below outer edge 33. Further, as can be seen, it is forward of the neck of the conical diaphragm 21 which is the junction of the conical diaphragm 21 with the damper member 24. This construction enables the speaker to be made the same size as a normal speaker in the vertical plane in FIG. 1 because the tweeter 32 does not project out beyond the outer edge 33 of the conical diaphragm 21. It is, however, rotatable in approximately 360° except for the matching projections 62 and 64 which prevent a full 360° rotation.

One version of the tweeter 20 is illustrated in FIG. 2 with the top dust cover 40 removed. The tweeter speaker 32 is a high-range speaker element within the upper portion 44 of spacer 26. Also included in spacer 26 is a hollow lower portion 46 having a plurality of petals 76 that can be deformed inwardly. As can be seen, the petals 76 are sloped downwardly at an angle inwardly. There is a projection 64 extending downwardly from the bottom one of the petals 76.

The matching base portion 22 has the hollow lower portion 48 and a hollow upper portion 50 with a hollow interior 70. The hollow upper portion 50 has a sloped inner surface 77 that matches the sloped petals 76 of the lower portion 46 of the spacer 26. When the lower portion 46 of the spacer 26 is inserted in the hollow top portion 50 of the base portion 22, the petals 76 are forced inwardly by the sloped surface 77 of the upper portion 50 of the base portion 22 until the petals 76 pass over shoulder 78 in the base portion 22 at which time they snap outwardly thus locking the spacer 26 to the base portion 22. The "buttons" or projections 56 on the lower portion 46 of the spacer 26 mate with indentations 52 on sloping surface 77 of the top portion 50 of the base portion 22. The indents match with the projections thus enabling a "clicking" and "holding" action when the spacer portion 26 is rotated with respect to the base portion 22. Projection 62 on shelf 64 in the upper portion 50 of the base portion 22 engages projection 64 of the high-frequency tweeter 20 and thus prevents a 360° rotation of the tweeter 32 with respect to the base portion 22.

Thus, as can be seen, the base portion 22 is attached to the low-range speaker 10 along its center axis of directivity 14 as can be seen in FIG. 1. The spacer 26 with the tweeter element 32 is rotatably mounted on and extends forwardly from the base portion 22 as shown in FIG. 1 and in FIG. 2 and has a top portion 44 and the bottom petal portion 46. The cap and dust cover 40 shown in FIG. 1 is removed in FIG. 2. The high-range speaker element 32 (otherwise known as the tweeter) is fixedly mounted on the top portion 44 of the spacer 26 and is positioned within the conical diaphragm 21 at an angle to the center axis 14 such that the directivity 38 of the high-range speaker element 32 is at a fixed angle 12 with respect to the center axis 14 and is arcuately positionable about the center axis 14 in planes perpendicular to the center axis.

Figure 4:
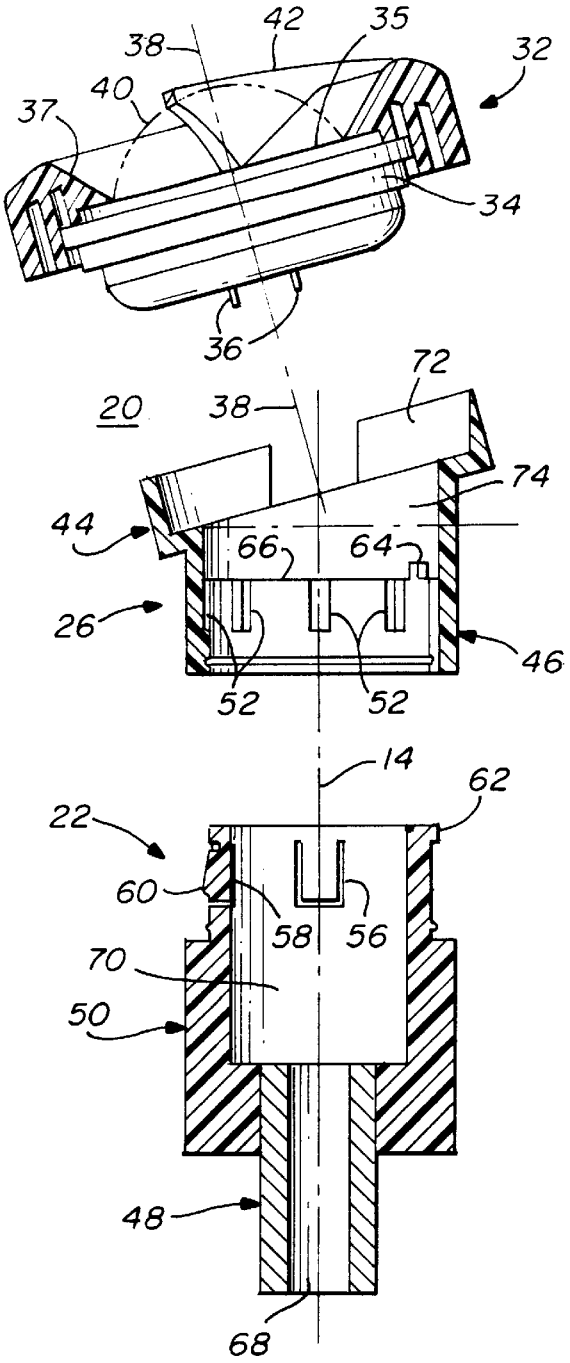
FIG. 4 is an exploded cross-sectional view of the second embodiment of the high-frequency speaker and its mounting arrangement as shown in FIG. 3.
Figure 3:
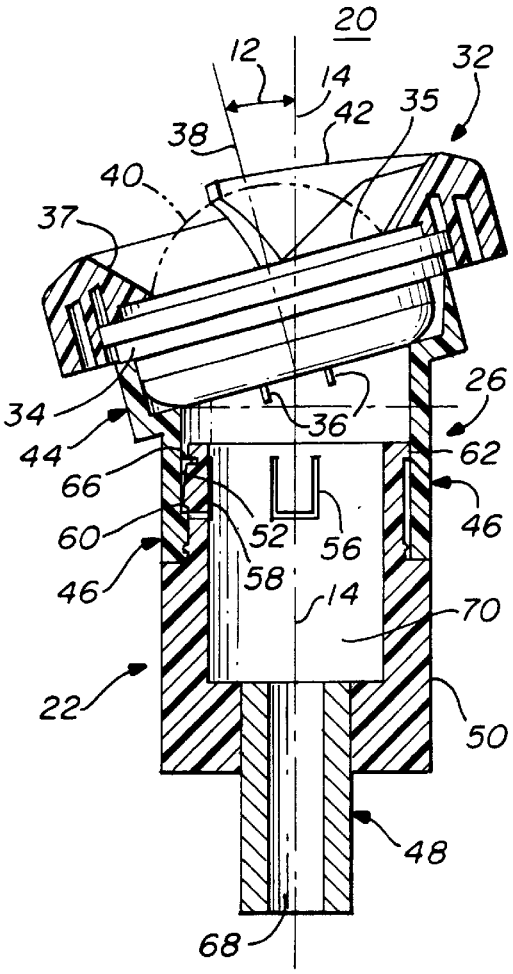
FIG. 3 is a cross-sectional view of a second embodiment of the high-frequency speaker.

It will be realized, of course, that the indents 52 and the projections 56 could be reversed as shown in FIG. 3 and FIG. 4. The projections 56 could be placed on the upper portion 50 of the base portion 22 and the indents 52 that are shown in FIG. 2 on the base portion 22 could be formed on the lower portion 46 of the spacer 32 that contains the tweeter. Further, if desired, the projections and indents could be placed alternately on each portion 46 and 50.

Thus as can be seen in FIG. 1, there is an orifice 69 in the first magnetic pole 27 extending along the center axis 14. The base portion 22 of high-range speaker 20, shown in FIG. 1, FIG. 2, and FIG. 3 has a first hollow portion 48 fixedly mounted in the orifice 69 in the first magnetic pole 27 as shown in FIG. 1 in any well-known manner as by cement. Speaker 20 also has a second hollow petal portion 46 in spacer 26 extending above the first hollow portion 48 of the base portion 22. The second hollow portion 50 receives the bottom portion 46 of spacer 26. As can be seen, the spacer bottom portion 46 is also hollow and is rotatably engaged with the second hollow portion 50 of the base portion 22.

The indents 52 and flexible projections 56 formed in respective ones of the second hollow portion 50 of the base portion 22 and the lower portion 46 of the spacer 26 enable each indent to mate with a corresponding projection to maintain the high-range tweeter speaker 20 in a set position while enabling the spacer 26 to be rotated with respect to the base portion 22 in a "clicking" manner to change the arcuate position of the high-range speaker 32 directivity.

As stated earlier, at least some of the indents 52 are arranged in a spaced circular pattern on the inside of the second hollow portion 50 of the base portion 22 and that at least some of the mating flexible projections 56 are arranged on the outside of the bottom portion 46 of the spacer 26. Further, as can be seen more clearly in FIG. 2, a circular shelf 66 is formed on the inside of the second hollow portion 50 of the base portion 22. A first projection 62 is associated with the circular shelf 66 and may extend upwardly therefrom as shown. A second projection 64 is associated with the bottom portion 46 of the spacer 26 for engaging the first projection 62 on shelf 66 during rotation of the spacer 26 to prevent 360° rotation of the spacer 26 with respect to the base portion 22.

Further, as can be seen in FIG. 1, a terminal board 16 is mounted on the audio speaker unit 10 having a pair of input terminals 17 thereon for receiving input signals. A first pair of conductors 19 is attached to the pair of input terminals 17 coupling input signals to the low-range speaker in a well-known manner. A second pair of conductors 18 is attached to the pair of input terminal 17 for coupling the input signals to the high-range speaker unit 20.

A second embodiment of the high-frequency tweeter is illustrated in FIGS. 3 and 4. In FIG. 3, the unit is shown assembled while in FIG. 4 the unit is shown in an exploded view.

Again, the tweeter unit 20 has a speaker unit 32, a spacer unit 26, and a base portion 22. Again, the base portion 22 has a lower portion 48 that can be attached to the low-range speaker along the center axis thereof as illustrated in FIG. 1. The spacer 26 is rotatably mounted on and extends forwardly from the base portion 22, the spacer 26 having a top portion 44 and a bottom portion 46. The high-range speaker unit 32 is fixedly mounted on the top portion 44 of the spacer portion 26 and is positioned within the conical diaphragm 21 of the low-frequency speaker as illustrated in FIG. 1. The speaker unit 32 is at an angle 12 to the center axis 14 such that the directivity 38 of the high-range speaker unit 32 is at a fixed angle 12 with respect to the center axis 14 is arcuately positionable about the center axis 14 in a plane perpendicular to the center axis.

In the alternative embodiment shown in FIGS. 3 and 4, the indents 52 are arranged in a spaced circular pattern on the inside of the lower portion 46 of the spacer 26. The mating flexible projections 56 and 58 are arranged on the outside of the second hollow portion 50 of the base portion 22 and flex inwardly to allow mating of the spacer lower portion 46 and the second hollow portion 50 of base 22.

Again, a circular shelf 66 is formed on the inside of the bottom portion 46 of the spacer 26. A first projection 64 is associated with the circular shelf 66 and may extend upwardly therefrom as shown. It engages a second projection 62 associated with the upper edge of the second hollow portion 50 of the base portion 22 for engaging the first projection 64 during rotation of the spacer 26 so as to prevent 360° rotation of the spacer with respect to the base portion 22.

The speaker unit 32 is shown in detail in FIGS. 3 and 4 and includes a magnet 34 for driving a high-frequency conical shaped speaker element 35 through signals received on terminals 36. The high-frequency speaker element 35 has a conical-shaped surface 37 for projecting the sounds along an axis of directivity 38. A cap and dome 40 may be formed over the speaker element 35 as a dust cover. A sound diffuser 42 may be placed partially over the dome 40 to assist in directing the sound in a well known manner.

In the speaker unit 32 shown in FIGS. 3 and 4, the base unit 22 is inserted on the inside of the lower portion 46 of spacer 26, which is the opposite of that embodiment shown in FIG. 2. Otherwise, the elements function in a similar manner.

Figure 5:
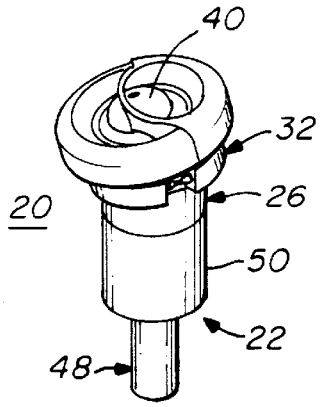
FIG. 5 is a perspective view of the assembled high-frequency speaker.

FIG. 5 is an isometric view of the tweeter 20 above illustrating base unit 22, spacer 26, and speaker unit 32 with cover 40. Base unit 22 also has shown bottom portion 48 and top portion 50.

Thus, the speaker unit disclosed herein includes a low-frequency range speaker 10 that has a conical diaphragm 21 extending outwardly and forwardly from a neck formed by the junction of the conical diaphragm 21 and the damper member 24, and provides a first sound output directivity along a center axis 14. The high-frequency range speaker 20 is rotatably mounted to the unit along the center axis 14 of the low-frequency range speaker 10 and is positioned within the conical diaphragm 21 and does not extend outwardly beyond the outer edge 33. It has a second sound output directivity 38 fixed at an angle 12 to the center axis 14 of the low-frequency range speaker 10 so that by rotating the high-frequency range speaker 20, the second directivity 38 can be arcuately positioned in planes perpendicular to the center axis 14.

The corresponding structures, materials, acts, and equivalents of all means or step plus function elements in the claims below are intended to include any structure, material, or act for performing the function in combination with other claimed elements as specifically claimed.

I claim:

1. An audio speaker unit comprising:

a low-frequency-range speaker with a conical diaphragm extending outwardly and forwardly from a neck about a center axis;

first and second magnetic poles for driving a voice coil coupled to said conical diaphragm of said low-range speaker;

an orifice in said first magnetic pole extending along said center axis;

a spacer rotatably mounted on and extending forwardly from said base portion, said spacer having a bottom portion and a top portion;

a high-range speaker element fixedly mounted on the top portion of said spacer portion and positioned within said conical diaphragm at an angle to said center axis such that the directivity of said high-range speaker element is at a fixed angle with respect to the center axis and is arcuately positionable about said center axis in at least one plane perpendicular to said center axis;

said base portion of the high-range speaker having a first hollow portion fixedly mounted in said orifice in said first magnetic pole, and a second hollow portion extending above said first hollow portion for receiving said spacer bottom portion; and said spacer bottom portion being hollow and rotatably engaged with said second hollow portion of said base portion.

2. The audio speaker unit of claim 1 further comprising:

indents and flexible projections formed in respective ones of said second hollow portion of said base portion and said lower portion of said spacer such that each indent mates with a corresponding projection to maintain the high-range speaker in a set position while enabling the spacer to be rotated with respect to said base portion to change the arcuate position of the high-range speaker directivity.

3. The audio speaker unit of claim 2 wherein:

at least some of said indents are arranged in a spaced circular pattern on the inside of the second hollow portion of said base portion; and at least some of said mating flexible projections are arranged on the outside of the bottom portion of said spacer.

4. The audio speaker unit of claim 3 further including:

a circular shelf on the inside of said second hollow portion of said base portion;

a first projection associated with said circular shelf; and a second projection associated with the bottom portion of said spacer for engaging said first projection during rotation of said spacer to prevent 360° rotation of said spacer with respect to said base portion.

5. The audio speaker of claim 4 comprising:

a terminal board on said audio speaker unit having a pair of input terminals thereon for receiving input signals;

a first pair of conductors attached to said pair of input terminals for coupling said input signals to said low-range speaker; and a second pair of conductors attached to said pair of input terminals for coupling said input signals to said high-range speaker.

6. The audio portion of claim 2 wherein:

said indents are arranged in a spaced circular pattern on the inside of the lower portion of said spacer; and said mating flexible projections are arranged on the outside of said second hollow portion of said base portion.

7. The audio speaker unit of claim 6 further including:

a circular shelf on the inside of said bottom portion of said spacer;

a first projection associated with said circular shelf; and a second projection associated with said second hollow portion of said base portion for engaging said first projection during rotation of said spacer so as to prevent 360° rotation of said spacer with respect to said base portion.

8. The audio speaker of claim 7 comprising:

a terminal board on said audio speaker unit having a pair of input terminals thereon for receiving input signals;

a first pair of conductors attached to said pair of input terminals for coupling said input signals to said low-range speaker; and a second pair of conductors attached to said pair of input terminals for coupling said input signals to said high-range speaker.

* * * * *